United States Patent [19]

Baumann et al.

[11] Patent Number: 4,928,147

[45] Date of Patent: May 22, 1990

[54] PRINTERS WITH SIMPLEX AND DUPLEX CUT SHEET FUSING

[75] Inventors: Gerald W. Baumann; Albert N. Garthwaite, both of Boulder; Carl D. Hutchings, Longmont, all of Colo.

[73] Assignee: International Business Machines Corporation, Armonk, N.Y.

[21] Appl. No.: 316,261

[22] Filed: Feb. 27, 1989

[51] Int. Cl.[5] ..... G03G 15/20

[52] U.S. Cl. ..... 355/288; 355/319; 355/23; 219/216

[58] Field of Search ..... 355/319, 318, 23, 24, 355/288, 282, 285; 219/216, 388

[56] References Cited

U.S. PATENT DOCUMENTS

| | | | |
|---|---|---|---|
| 4,067,649 | 1/1978 | Hubbard et al. | 355/14 |
| 4,272,181 | 6/1981 | Treseder | 355/14 |
| 4,386,840 | 6/1983 | Garthwaite et al. | 355/3 FU |
| 4,434,353 | 2/1984 | Marsh et al. | 219/216 |
| 4,488,801 | 12/1984 | Gibson | 355/3 SH |
| 4,496,142 | 1/1985 | Iwasaki | 271/3 |
| 4,526,459 | 7/1985 | Bresnick | 355/285 |
| 4,541,705 | 9/1985 | Knechtel | 355/3 FU |
| 4,768,057 | 8/1988 | Kumada et al. | 355/288 |

FOREIGN PATENT DOCUMENTS

| | | |
|---|---|---|
| 131285 | 5/1982 | Japan . |
| 200566 | 5/1986 | Japan . |
| 2159462 | 12/1985 | United Kingdom . |

OTHER PUBLICATIONS

IBM Technical Disclosure Bulletin by D. M. Janssen et al. Entitled "Electrophotographic Printer with Duplex Capability", vol. 24, No. 1B, 6/81, pp. 810–811.

*Primary Examiner*—R. L. Moses

*Attorney, Agent, or Firm*—Earl C. Hancock; Charles E. Rohrer

[57] ABSTRACT

Image defining toner is transferred to cut sheets and fused at one of two fuser stations. One station is positioned to fuse the image on one side when duplex copying or printing is selected. The other fuser station performs fusing when simplex copying is selected but fuses the second side copy for duplexing. When flash lamps are employed for the fuser station, the lamps are composed of multiple bays with a single power source coupled to each bay in sequence so that the power source size need only accommodate the power level demand of one bay. The time between trigger pulses is extended by commencing fusing with an intermediate bay followed by the initial bay and then the final bay as the image area requiring fusing passes along its path in proximity to the faces of the flash lamp bays.

10 Claims, 3 Drawing Sheets

PRINTERS WITH SIMPLEX AND DUPLEX CUT SHEET FUSING

TECHNICAL FIELD

The present invention relates to printers which transfer an image defined by loose toner from a carrier to a predetermined area of a media where the toner is fused to create a fixed, visible image. More particularly, the present invention relates to machines that utilize electronic controls to place an image on a xerographic or electrophotographic carrier and thereafter transfer toner which defines that image to an image area on a sheet of media where the toner is fused to render the image permanently visible. Although not necessarily limited thereto, the present invention is especially useful for xerographic or electrophotographic printers which can handle either simplex or duplex copying.

BACKGROUND OF THE INVENTION

Contemporary xerographic or electrophotographic printers and copiers include a device to fuse or permanently bond loose toner transferred from a photoconductor carrier to a cut sheet media such as paper. The more common fuser structures employed for this purpose include the heated roller type and the flash fuser type. In the former, the toner is melted onto the media substrate by heated rollers that press against the media sheets whereas the latter is energized to cause fusing by intense heat and light impinging upon a relatively wide area for a very brief period of time.

In commonly-assigned U.S. Pat. No. 4,386,840 by Garthwaite and Suarez, multiple flash fuser heads are sequentially actuated from a common power supply to effect fusing on different portions of the copy media. This permits minimization of the power supply size. It is also known to employ a plurality of fuser lamps and to actuate them in sequence as in Japanese Patent JA 55-131285, or to stagger the heads but fire them all at the same time as in Japanese Patent JA 61-200566. Yet another configuration is shown in U.S. Pat. No. 4,434,353 by Marsh wherein selected flash heads are energized as a function of the length of the copy sheet under consideration. These fuser lamps may actually perform drying functions when liquid developer is in use as in U.K. Patent 2,159,462.

Machines for duplex copying or printing are configured in several arrangements. For instance, a separate storage tray is sometimes used with the copy sheet returned to the original transfer station as in U.S. Pat. No. 4,067,649 by Hubbard, LeClere and Underhill. A reversing drum and flipper structure is employed in U.S. Pat. No. 4,272,181 by Treseder.

A single flash fuser with a return path to a duplex reversing roller so that the first side is completely handled before the copy sheet is returned over a reversing roller to the image station for second side image processing is shown in the IBM TECHNICAL DISCLOSURE BULLETIN of June 1981 at pages 810–811. Copy sheet return paths for reversing the copy sheet and returning it to the imaging station after hot roll fusing are shown in U.S. Pat. Nos. 4,488,801 by Gibson and 4,496,142 by Iwasaki. U.S. Pat. No. 4,541,705 by Knechtel is somewhat similar except it includes an intermediate set of fuser rollers in the return path.

DISCLOSURE OF THE INVENTION

This invention relates to the configuration of an electrophotographic machine, wherein two or more fusing stations are used so that the machine operating efficiency is enhanced as compared to the known prior art. In one aspect of machines in accordance with this invention, side one of duplexed copies are fused before the sheet enters the transfer station for imprinting the second side. One fusing station fuses all simplex and the second side of duplex. The second fusing station fuses the first side of duplex only.

Another feature of this invention relates to the area of flash fusing and the use of the two flash heads (or sets of flash heads). One of the flash heads fuses one side of the print paper with the other flash head fusing on the duplex side. One power supply is used per pair of heads thereby reducing the number of power supplies necessary to operate the flash fuser. By spacing the flash heads for simplex and duplex image transferring, the use of one power supply per pair of flash heads is all that is needed.

The disclosure herein using a machine configuration with two fusing stations enjoys the advantage of avoiding situations wherein it is necessary to handle cut sheet paper with unfused images on both sides. Flash fusers are the preferred type of fusing station and positive gripping of the paper (via vacuum transport) is preferred in order to time the flashes accurately and easily. Furthermore, the image rate is the same for duplex as it is for simplex which is not true for prior art systems which employ sequential information processing through a hot roll duplex loop.

Yet another aspect of this invention relates to a multiple head flash fuser used with an electrophotographic machine, and involves timing the flash of each head to provide maximum time intervals between flashes while still completely fusing the toner image onto the document. While not essential, a vacuum transport is preferably used in order to position the paper at a known location so that the entire document is fused by the multiple flashes. In one configuration according to this aspect of the invention, toner type of fusible material is bonded to a discrete image area on the surface of a substrate which is passed along a path under a fuser. The fuser includes a series of at least three bays arranged so that the substrate encounters an initial one of the bays followed by at least one intermediate bay and a final one of the bays in sequence as the substrate moves along the path. These fuser bays are each capable of responding to an enabling signal for directing heat onto the surface of the substrate carrying the image defining fusible material.

A first enabling signal is generated for actuating an intermediate one of the fuser bays when the leading edge of the substrate image area is in alignment with the downstream boundary of the intermediate fuser bay. A second enabling signal is then generated for actuating the initial bay when the trailing edge of the substrate image area is in alignment with the upstream boundary of the initial bay. Finally, a third enabling signal is generated for actuating the final bay when the portion of the substrate image area intermediate the leading and trailing edges is in substantial alignment with the final bay.

In the case of a three bay fuser head in particular sequentially arrayed along the copy sheet path (i.e., 1, 2 and 3), the bays are actuated with a sequence of flashing in a 2, 1, 3 order to provide the longest time interval between flashes. This feature is useful for either fan-fold or cut sheet copy media.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
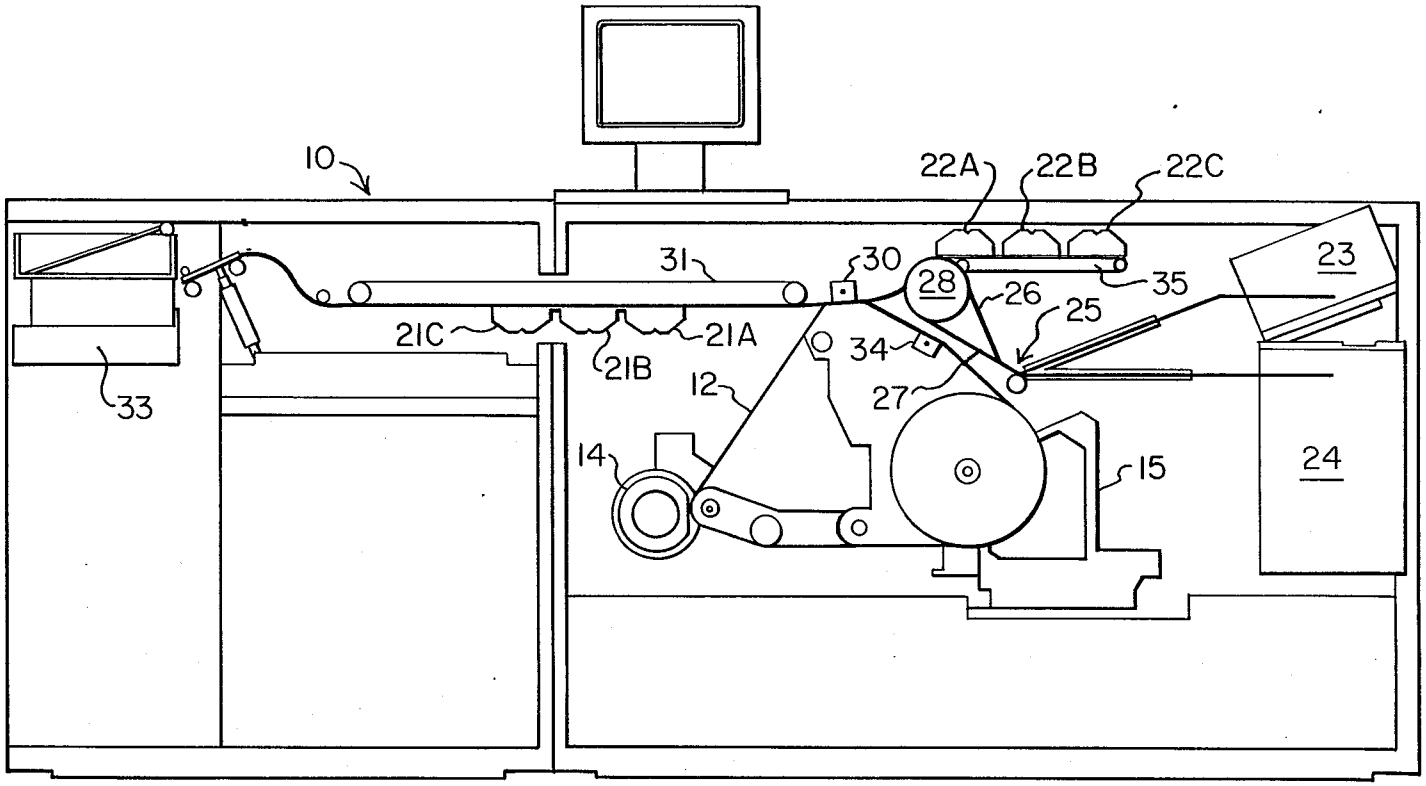
FIG. 1 is a somewhat schematic view of a xerographic printer including a dual flash fuser arrangement in accordance with this invention.

FIG. 1 is a machine 10 in a configuration for handling cut sheet duplex image printing or copying using flash fusers. In the example shown, a belt type photoconductor 12 continuously rotates past a cleaning station 14, imaging station (not shown) and developer 15 where toner is applied in accordance with the discharged (or charged) image on belt 12 as is well known. Charging and discharging of belt 12 is also well known with those functions performed by elements not shown.

The FIG. 1 embodiment uses two flash heads or, in this case, sets of flash heads 21 and 22. Set 21 fuses all simplex and the second side of duplex. The second set 22 fuses the first side of duplex only. The first side of duplex is fused prior to transfer of the image on the second side of duplex.

There are several benefits of the FIG. 1 configuration. First, by fusing the first duplex image prior to transfer of the second image, paper handling is improved. There is no need for a system to handle paper with unfused toner on both sides. Second, nearly immediate fusing of each image after transfer occurs which may minimize any damage to the image during handling. Finally, flash head reliability should remain the same because more flash heads are sharing the same number of images. Even though there are more heads, they should last longer.

Cut sheets are stored in bins 23 and 24 which are selected by the machine to feed the sheets seriatim into the paper path and junction 25 thereof. Here a gate is enabled to direct the sheets to either path 26 if simplex copies are in process, or to path 27 if duplexing is involved. For simplex image transfer, the cut sheet media is directed along path 26 and around drum 28 before introduction to image transfer station 30 where toner establishing the image is transferred onto the sheet from belt 12. The sheet then is gripped by output vacuum transport 31 before it is passed over the three bay flash fuser set 21. Thus the toner on the sheet is not disturbed by the sheet handling structure during simplex operation and the sheet is ultimately delivered to an output receptacle 33.

When duplex copying is intended, the paper is directed onto reversing drum 28 after receiving an image on its lower side at transfer station 34.

As with simplex copying, the toner defining this first duplex image is not disturbed by any sheet handling mechanism because the non-imaged side of the sheet is directed onto vacuum transport 35 and under the three bay flash fuser station 22 where the image is fixed permanently. By appropriate timing controls, the second image on the belt 12 is coordinated with reversed movement of the sheet from transport 35 over drum 28 and through transfer station 30 where the second image is delivered to the other side of the sheet. It is then sent through fuser station 21 and on to the output 33 as with the simplex copy mentioned above.

Alternating flash heads for single pass duplex imaging with flash fusing in accordance with this invention allows for fusing both sides of a single pass duplex sheet with optimum use of power supplies and power with the reliability of a flash fuser. In U.S. Pat. No. 4,386,840 "Dual Flash Fuser Reflector with Alternating Flash For Power Reductions" by A. N. Garthwaite and L. A. Suarez mentioned previously herein, flash fusing with two flash heads supplied by one power supply is shown. Both flash heads are on the simplex paper path. Flashes are spaced evenly to reduce the size of the power supply required to operate the system.

This invention applies to any cut sheet, single pass duplex machine suitable for a flash fuser. The invention relates to the use of at least two flash heads (or sets of flash heads) to fuse both sides of a duplex imaged print. Potential embodiments of this are illustrated somewhat schematically in FIGS. 2 and 3, with FIG. 2 generally comparable to the organization of FIG. 1.

Figure 2:
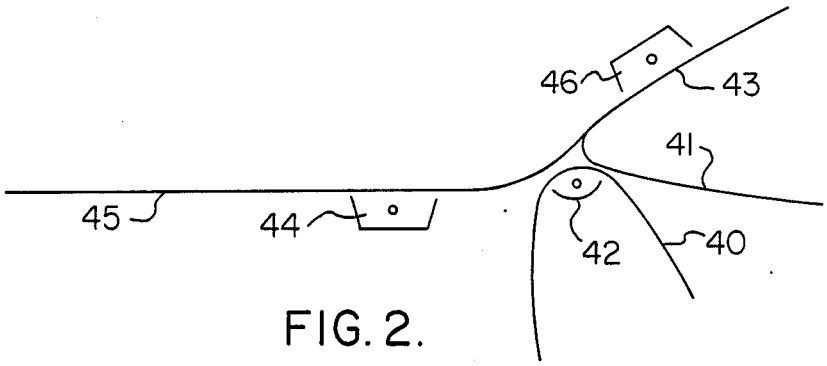
FIG. 2 is a simplified diagram of the paper paths and fuser locations for a system similar to FIG. 1.

In FIG. 2, the photoconductor belt 40 has a toner image for transfer to cut sheets on input path 41 at transfer station 42. One flash fuser head 44 in output path 45 is used for all simplex fusing and one side of duplex fusing. The other head 46 is associated with the reversing or flipper path 43, and is used only for the other side of duplex fusing.

Figure 3:
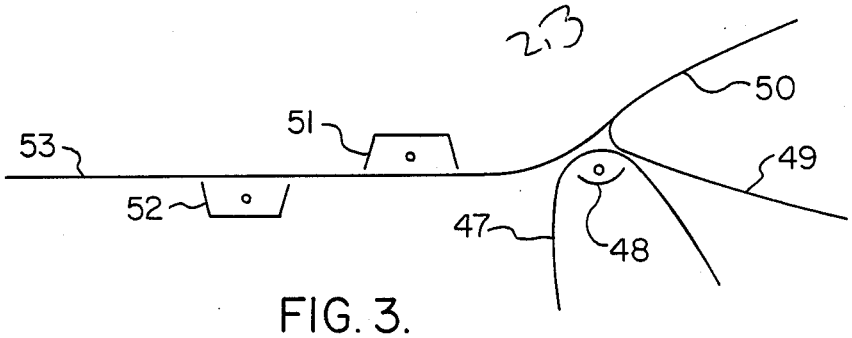
FIG. 3 is a diagram of another embodiment along the lines of the FIG. 2 version.

The FIG. 3 embodiment is similar except the duplex flash head set 51 is in the output path 53 instead of the reversing path 50. In this configuration, both images of a duplex set are transferred before fusing at fuser stations 51 and 52. The copy sheet media arrives in input path 49 and the first side of the duplex image is transferred from the photoconductor belt 47 to the sheet at transfer station 48. The sheet is then diverted into flipper path 50 and returned to transfer station 48 to receive the second side image. The sheet then passes initially through flash fuser station 51 and thereafter through flash fuser station 52.

FIG. 3 is an alternative operation to FIG. 2 and has the disadvantage of requiring more handling of the sheet with unfused images on both of its sides. Careful positioning and design of the sheet handling conveying means will avoid smearing of the loose toner images. Use of vacuum conveyors or other margin or edge gripping mechanisms may prove suitable for this purpose. Preferably, fuser stations 51 and 52 are spaced to permit sharing of a common power supply.

Figure 4:
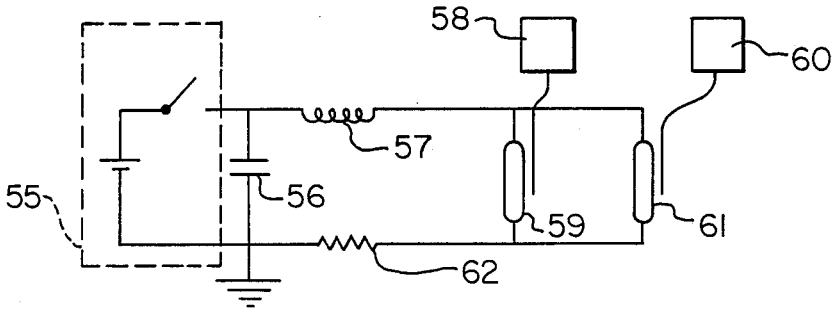
FIG. 4 is an electrical schematic diagram of a power system for actuating fusers in accordance with this invention.

FIG. 4 is an electrical schematic of the single power supply needed per pair of heads such as 44/46 or 51/52.

A primary DC power source 55 is switched into a discharge network of energy storage capacitor 56 and inductor 57. A trigger signal source 58 introduces an enabling signal to the first flash fuser 59 whereas a second trigger signal source 60 is connected to control fuser 61. Note that flash fuser heads 59 and 61 correspond respectively to fuser heads 44 and 46 in FIG. 2, and fuser heads 51 and 52 of FIG. 3.

Thus it is possible to have both heads hard wired to the power supply, but with separate trigger sources applied to each head. By balancing the physical spacing of the heads and therefore the flash timing, a single power supply 55 is all that is required to drive two flash heads. It is possible to maintain a constant number of impressions per minute, regardless of simplex or duplex operation by the machine. Accordingly, this invention is of benefit on machines in which both sides of a print are transferred prior to fusing (FIG. 3), or machines in which the simplex paper path through the fuser is different than the duplex path. It is also useful to fuse the image to the first side prior to transfer of the image to the second side.

Several benefits flow from this invention. For instance, the designer can realize optimum cost and size of the fuser due to power supply sharing. The power supply is used at its rated speed in both simplex and duplex. Further, the power requirements for the system are minimized and are the same for simplex or duplex. Also reliability of the system is not significantly different from a single head system. Although there are more flash heads, the combined usage is the same.

Another embodiment of this invention allows 100% area fusing of fan fold paper while utilizing a modular design of the flash head. Previous fuser flash heads achieved this result only with difficulty. A narrow head with one bulb required two or multiple flashes per page for fusing. Alternatively, a wide head with two bulbs fired simultaneously while only requiring one flash per page, demands that the active area of the flash head cover the entire page equivalent to a cut sheet application.

In a flash head and power supply type of modular system, a flash head and power supply are designed to operate at some maximum repetition rate. If the print rate of a machine requires a rate which exceeds the maximum, an additional modular flash head and power supply is added to the machine. It is preferable to adapt one modular design to various machines and the number used will depend on the process speed. The flash heads in each of the modular units typically contain a reflector system inside a supporting structure. These supporting structures, when packaged side-by-side, will have a space between them that is a dead zone and toner will not fuse in that area when the bulbs are fired simultaneously.

The aforementioned problems are overcome by sequentially firing the flash heads so that the unfused portion of the paper can advance to the next flash head before that head is fired. Some overlap fusing is needed to accommodate tolerances. One trigger circuit and one power supply is provided for each flash head module. If more than two flash heads are used in a system, there is more than one timing sequence that will satisfy the fusing requirements.

Figure 5:
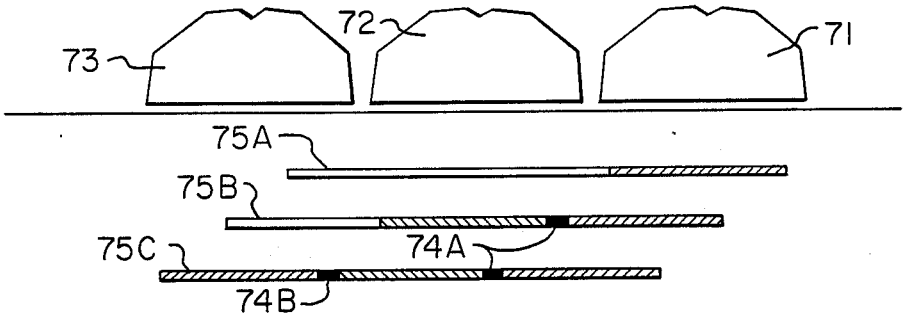
FIG. 5 is a diagram showing a typical contemporary method of fuser actuation.

Some prior art devices employ a multiple flash head fuser system and generally function as shown in FIG. 5. Adjacent flash heads in the form of xenon flash lamps 71, 72 and 73 are fired sequentially, with a timing interval equal to g/v, where g is the optical gap between flash heads and v is the velocity of paper 75 shown in three consecutive positions 75A, 75B and 75C. The width of the bays for lamps 71, 72 and 73, along with appropriate timing of the trigger signals, causes some intentional overlap as indicated at 74A and 74B thereby ensuring there are no unfused areas on sheet 75 when the operation is completed. While this scheme does work and fuses the image completely, it exacerbates two problem areas of the system.

Figure 6:
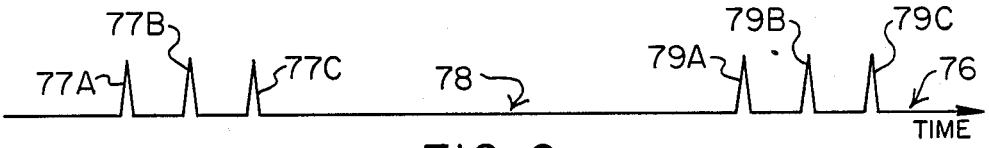
FIG. 6 is a time based diagram of the trigger pulse groups employed in a FIG. 5 operation.

First, since g is usually small relative to the optical width of the flash heads, all flash heads are fired in rapid sequence, followed by a long dead time. This is illustrated in the time based diagram at FIG. 6 which shows the trigger line 76 associated with heads 71–73. The first sequence of three pulses 77A–77C is followed by a long quiescent period 78 and then three more rapid pulses 79A–79C. The air in the flash head assembly is laden with odoriferous volatiles, and the rapid heating during the flash causes the air to pump out of the fuser assembly, contaminating the air in the machine and ultimately the air in the environment external to the machine. Rapidly firing all flash heads exacerbates this problem (as opposed to increasing the delay between firing the lamps).

A second problem stems from the fact that the flash power supplies draw considerable current during charge. In a typical cycle, there is a charge period, followed by a dead time prior to firing. Then there is a second dead period after the flash, to prevent the flash tube from staying on during the charge cycle. By evenly spacing the firing timings, the peak current draw of the machine is reduced in a machine with three or more flash heads. The prior art approaches preclude this even timing spacing.

By the present invention, the volatile air pumping and the peak current draw are both reduced by more evenly spacing the lamp 71–73 firing intervals. To illustrate, consider the flash head assembly described above, with:

g=optical gap between flash heads
w=optical width of flash head
v=paper velocity Assume the flash heads are numbered 1, 2, 3 (in the direction of paper motion). The firing sequence in the FIG. 5 design (1, 2, 3) gives timing intervals of g/v, g/v, (3w−2g)v. Typically, g/w is as small as possible. Thus the firings occur in very rapid succession, with a long dead time. Assume further by way of example that for a particular machine hardware, w=91 mm, g=29 mm, and v=652 mm/sec. With the FIG. 5 sequence, the flash timings are 44 msec between 77A and 77B, 44 msec between 77B and 77C, and 330 msec for gap 78 between 77C and 79A.

Figure 7:
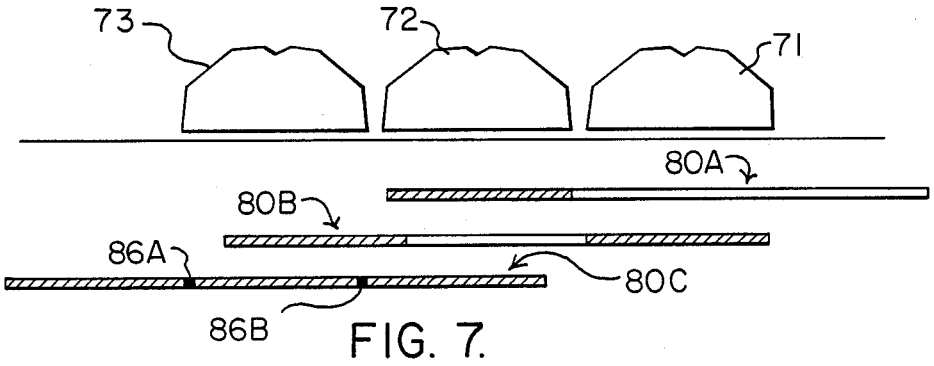
FIG. 7 is a diagram showing a flash fuser actuation sequence in accordance with one embodiment of this invention.
Figure 8:
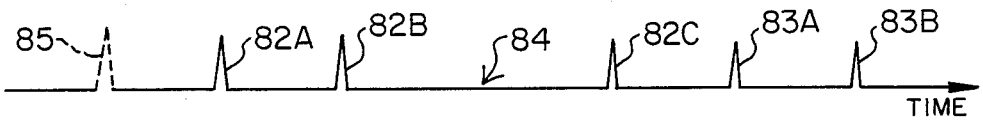
FIG. 8 is a time based diagram of the trigger pulse groups for a FIG. 7 operating environment.

In accordance with this embodiment of the invention, the firing sequence, as shown in FIGS. 7 and 8, is changed to 3,2,1 in the direction of paper motion, the sequence 2,1,3 is equivalent and is shown on FIG. 8. That is, during paper line start-up, the system starts on flash head 72. This new sequence would change the timing intervals to (w−g)/v, (w−g)/v, (w+2g)/v. This is typically a much more even timing than the former one.

In the present example with the above machine assumptions, the fusing is accomplished on cut sheet 80 with timings which become 95 msec for the shortest period between trigger pulses, and 228 msec as the longest gap. That is, lamp 72 fires in response to pulse 82A, lamp 71 for pulse 82B and lamp 73 fires for pulse 82C. The time between 82A and 82B is 95 msec, while the 82B to 82C gap is 228 msec. Thus the shortest time between trigger pulses is increased from 44 msec to 95 msec while the longest period is reduced from 330 msec to 229 msec.

Thereafter, the time until the first trigger pulse of the next set for the succeeding sheet is 95 msec as shown between 82C and 83A. Note that, once the system commences handling sequences of sheets one after the other, a regular sequence of three pulse sets occurs as is suggested by the dotted pulse 85 representing the last pulse of a set that might precede trigger set 82.

In any system with n flash heads there are $(n-1)!$ distinct firing sequences. In general, the same benefits pursuant to this invention are gained with systems having four or more flash lamps by choosing a sequence other than a 1,2,3, etc., firing order. In general, 1,n,n-1,n-2, . . . is the improved firing sequence.

Note that the firing of lamp 73 creates overlap bands 86A and 86B to ensure that the sheet 80 surface is completely fused as is the case for the bands that are required with a 1,2,3 triggering sequence. As mentioned, advantages of this invention include reduced pumping of volatile gases out of the flash fuser, and reduced total RMS current into the bank of flash power supplies. The fuser element environment and the power system are both better able to recover between actuation in response to a triggering pulse sequence.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. Apparatus for handling transfer of fusible material corresponding to images from an image generator to discrete sheets of media in either simplex or duplex form comprising a source for producing media sheets seriatim, a transfer station means including means for motivating the fusible material from the image generator to the media sheets, means for introducing media sheets from said source to said transfer station means, first and second flash fusing means for fusing the fusible material to the media sheets, first and second output paths from said transfer station means each including a respective one of said flash fusing means, one of said output paths including means for returning received media sheets to said transfer station means for receiving image defining fusible material on the side thereof opposite the side which received the first image from said transfer station means, means producing a signal indicative that duplex image transferring is to occur, means responsive to said signal producing means for selectively switching the output from said transfer station means to said one of said output paths and for otherwise directing the output of said transfer station means to the other of said output paths, an electrical power source means, and control means selectively coupling said electrical power source means for actuating one of said flash fusing means which has a media sheet in proximity thereto for causing said actuated flash fusing means to fuse the fusible material on that media sheet.

2. Apparatus in accordance with claim 1 wherein said fusing means are each flash fusing assemblies, said control means including means operable during duplex image transferring for actuating said fusing assembly in said one of said paths and for actuating said fusing assembly in said other of said output paths for fusing on the opposite side of said media sheet after it exits from said transfer station means.

3. Apparatus for handling transfer of fusible material corresponding to images from an image generator to discrete sheets of media in either simplex or duplex form comprising a source for producing media sheets seriatim, a transfer station means including means for motivating the fusible material from the image generator to the media sheets, means selectively operable for introducing media sheets from said source to said transfer station means in either a first direction or a second direction opposite said first direction, first and second means for fusing the fusible material to the media sheets, and first and second output paths each including a respective one of said fusing means, said first output path receiving sheets from said transfer station whenever such sheets pass through said station in said first direction, the other of said output paths receiving sheets which have passed through said transfer station in said second direction and further including means for returning received media sheets to said transfer station means for receiving image defining fusible material on the side thereof opposite the side which received the first image from said transfer station means.

4. Apparatus in accordance with claim 3 which further includes means producing a signal indicative that duplex image transferring is to occur, means responsive to said signal producing means for selectively switching the input to said transfer station means to introduce sheets to said transfer station in said second direction and for otherwise directing the sheet input of said transfer station means to introduce sheets to said transfer station in said first direction.

5. Apparatus in accordance with claim 4 which further includes an electrical power source means, and control means selectively coupling said electrical power source means for actuating one of said fusing means for causing said actuated fusing means to fuse the fusible material on the media sheets whenever said sheets are present.

6. Apparatus in accordance with claim 5 wherein said fusing means are each flash fusing assemblies.

7. Apparatus for handling transfer of fusible material corresponding to images from an image generator to discrete sheets of media in either simplex or duplex form comprising a source for producing media sheets seriatim, a transfer station means including means for motivating the fusible material from the image generator to the media sheets, means selectively operable for introducing media sheets from said source to said transfer station means, first and second means for fusing the fusible material to the media sheets, an output path from said transfer station means including said first fusing means on one side thereof and said second fusing means on the opposite side thereof, means operable when duplex image transfer operations are selected for receiving sheets from said transfer station means and returning each sheet to said transfer station means for transferring image defining fusible material on the side thereof opposite the side which received the first image from said transfer station means, means directing the sheets into said output path after image transfer at said station means is completed, and means operable after each media sheet enters said output path for actuating said first fusing means when duplex images were transferred at said transfer station means and for actuating both said fusing means when duplex images were transferred at said transfer station means.

8. Apparatus in accordance with claim 7 wherein said first and second fusing means are in spaced relation along said output path, said actuating means including a single power source and means for sequentially actuating said first and second fusing means from said power source.

9. Apparatus for bonding fusible material to a discrete image area on the surface of a substrate wherein the substrate is passed along a path under a fuser which includes a series of at least three bays arranged so that the substrate encounters an initial one of the bays followed by at least one intermediate bay and a final one of the bays in sequence as the substrate moves along the path and wherein each of the bays is capable of responding to an enabling signal for directing heat onto the surface of the substrate which carries the fusible material comprising means generating a first enabling signal for actuating an intermediate one of the fuser bays when the leading edge of the substrate image area is in alignment with the downstream boundary of said intermediate fuser bay, means generating a second enabling signal for actuating the initial bay when the trailing edge of the substrate image area is in alignment with the upstream boundary of said initial bay, and means generating a third enabling signal for actuating the final bay when the portion of the substrate image area intermediate the leading and trailing edges is in substantial alignment with said final bay.

10. Apparatus in accordance with claim 9 which includes a single power source commonly connected to all said fuser bays, each said fuser bay having an electrode for actuating the said fuser bay associated therewith, and means coupling said actuating signal generating means to respective said fuser bay electrodes.

* * * * *